US009227767B2

(12) United States Patent
Futase

(10) Patent No.: US 9,227,767 B2
(45) Date of Patent: Jan. 5, 2016

(54) PACKAGE BAG AND METHOD FOR FILLING AND PACKING LIQUID MATERIAL TO BE PACKED

(75) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 39 days.

(21) Appl. No.: 13/883,353

(22) PCT Filed: Nov. 16, 2011

(86) PCT No.: PCT/JP2011/076348

§ 371 (c)(1),
(2), (4) Date: May 3, 2013

(87) PCT Pub. No.: WO2012/067129

PCT Pub. Date: May 24, 2012

(65) Prior Publication Data

US 2013/0223768 A1 Aug. 29, 2013

(30) Foreign Application Priority Data

Nov. 17, 2010 (JP) ..... 2010-256485

(51) Int. Cl.

| | |
|---|---|
| ***B65D 30/24*** | (2006.01) |
| ***B65B 1/04*** | (2006.01) |
| ***B65D 33/00*** | (2006.01) |

(Continued)

(52) U.S. Cl.

CPC . *B65D 33/00* (2013.01); *B65B 3/04* (2013.01); *B65B 3/045* (2013.01); *B65B 3/18* (2013.01); *B65B 51/146* (2013.01); *B65D 31/14* (2013.01); *B65D 81/24* (2013.01)

(58) Field of Classification Search

CPC .. B65D 31/14; B65D 31/145; B29C 66/1122; B29C 65/18

USPC ..... 383/44, 116, 906; 53/469, 479

See application file for complete search history.

(56) References Cited

U.S. PATENT DOCUMENTS

| | | | | |
|---|---|---|---|---|
| 3,186,625 | A * | 6/1965 | Mcad et al. | 383/37 |
| 4,470,152 | A * | 9/1984 | Blankenship | 383/37 |

(Continued)

FOREIGN PATENT DOCUMENTS

| | | |
|---|---|---|
| JP | 56-75146 | 6/1981 |
| JP | 62-500296 | 2/1987 |

(Continued)

OTHER PUBLICATIONS

Machine translation of Japanese Document No. JP 2005206241 A.*

(Continued)

*Primary Examiner* — Jes F Pascua

(74) *Attorney, Agent, or Firm* — Greenblum & Bernstein, P.L.C.

(57) ABSTRACT

There are provided a package bag capable of surely preventing stay of ambient air or the like in the package bag and intake thereinto even in the filling by handwork or the like of an operator as well as a method for filing and packing the liquid material to be packed into the package bag. A package bag is characterized by comprising a bag main body made of thin laminate films for packing, a fusion part formed at a position spaced from a bottom portion of the bag main body not forming a nozzle through fusion and extending in a widthwise direction of the bag main body, an insert port for a pipe-like filling nozzle provided in a middle portion of the fusion part, a filling part of one-way function formed between the fusion part and an opening end of the bag main body.

7 Claims, 9 Drawing Sheets

(51) Int. Cl.

| | |
|---|---|
| ***B65B 3/04*** | (2006.01) |
| ***B65B 3/18*** | (2006.01) |
| ***B65D 81/24*** | (2006.01) |
| ***B65B 51/14*** | (2006.01) |

(56) References Cited

U.S. PATENT DOCUMENTS

| | | | | |
|---|---|---|---|---|
| 4,634,006 | A * | 1/1987 | Yanase | 383/204 |
| 4,671,044 | A | 6/1987 | An | |
| 4,910,147 | A * | 3/1990 | Bacehowski et al. | 435/304.1 |
| 2002/0108697 | A1 | 8/2002 | Perkins et al. | |
| 2005/0041888 | A1 * | 2/2005 | Matsuzawa et al. | 383/9 |
| 2008/0008403 | A1 * | 1/2008 | Fergusson et al. | 383/40 |
| 2008/0264970 | A1 | 10/2008 | Kasai | |
| 2010/0072224 | A1 * | 3/2010 | Ha | 222/107 |

FOREIGN PATENT DOCUMENTS

| | | | | |
|---|---|---|---|---|
| JP | 03242157 | A * | 10/1991 | A62C 11/00 |
| JP | 04006044 | A * | 1/1992 | B65D 30/16 |
| JP | 04-072104 | | 3/1992 | |
| JP | 06-048401 | | 2/1994 | |
| JP | 2001139058 | A * | 5/2001 | B65D 77/06 |
| JP | 2002-240832 | | 8/2002 | |
| JP | 2004-505862 | | 2/2004 | |
| JP | 2005-015029 | | 1/2005 | |
| JP | 2005-059958 | | 3/2005 | |
| JP | 2005206241 | A * | 8/2005 | B65D 30/24 |
| WO | 86/01485 | | 3/1986 | |
| WO | 02/14156 | | 2/2002 | |
| WO | WO 2009139299 | A1 * | 11/2009 | B65D 75/58 |
| WO | 2010-004853 | | 1/2010 | |

OTHER PUBLICATIONS

Machine translation of the description of Japanese Document No. 2001-139058. Translated on Oct. 24, 2014.*

International Search report dated Feb. 21, 2012 with English language translation.

International Preliminary Report on Patentability dated May 21, 2013 with English language translation.

* cited by examiner

PACKAGE BAG AND METHOD FOR FILLING AND PACKING LIQUID MATERIAL TO BE PACKED

TECHNICAL FIELD

The present invention relates to a flexible package bag made of thin plastic laminate films for packing, and a method for filling and packing a liquid material to be packed into the package bag. More particularly, the present invention proposes a technique of preventing oxidation, contamination and the like of a material packed in the package bag through air or the like not only by simply and surely conducting ex-post discharge and removal of ambient air and other gas, which have entered into the package bag together with the liquid material through a pouring nozzle or the like, from the package bag with, for example, handwork of an operator, but also by surely inhibiting unintentional penetration of ambient air into the package bag during the sealing of an opening part in the package bag through fusion or the like.

BACKGROUND ART

Patent Documents 1 to 3 disclose a flexible package bag provided with a liquid pouring nozzle having a self-sealing one-way function which can prevent penetration of ambient air into the package bag when a liquid material to be packed is poured from a package structure formed by filling and packing the liquid material into the package bag under evacuation. When the liquid material packed in the package bag is poured from the bag, a tip fused portion of the pouring nozzle is removed by tearing with fingers and the like to form a pouring port at the tip of the pouring nozzle, and then the package bag is tilted so as to form a downward posture of the nozzle pouring port. In this case, the tip pouring port of the pouring nozzle made of the flexible laminate films is separated away toward front and rear sides under the action of hydraulic head pressure of the packed liquid material to allow for the required pouring of the packed liquid material.

When the liquid material packed in the bag is poured in such a manner, the main body of the flexible package bag is subjected to shrinkage or collapse deformation by a quantity corresponding to the poured volume associated with the pouring of the packed material without intake of ambient air.

After the predetermined amount of the packed material is poured by tilting the package bag, the pouring is stopped by returning the package to the original standing posture. In the stop of the pouring, the inner surfaces of the nozzle wetted with the packed material are mutually adhered under the intervention of the thin film-like packed material through capillary action or the like over a whole area in a widthwise direction of the front and rear films of the pouring nozzle, namely in a vertical direction thereof at the same time of the pouring stop, whereby the tip pouring port of the nozzle is closed to surely inhibit the penetration of ambient air into the package bag.

In the package bag provided with the pouring nozzle, therefore, the packed material in the bag is sufficiently protected from contacting with ambient air before, during and after the pouring of the packed material, and hence oxidation, contamination and the like of the packed material in the bag can be prevented effectively.

The above-mentioned adhesion between the inner surfaces of the front and rear plastic films constituting the pouring nozzle is automatically carried out by returning the package bag to the standing posture to release the pouring nozzle from the action of hydraulic head pressure to thereby return to the original production form, and further by adsorbing the inner surfaces of the front and rear films wetted with the packed material to each other under an atmosphere of a reduced pressure generated when the packed material in the pouring nozzle flows back to the inside of the main body of the package bag. Such an adhesion is attained more surely when the main body of the package bag shrunk or collapse-deformed with the pouring of the packed material from the package bag acts to render the inside thereof into a reduced pressure based on the elastic restoring force inherent to the package bag.

Here, the tip pouring port of the package bag can be automatically closed and sealed with the returning of the package bag to the standing posture without special operation of the pouring nozzle or the like, and also the excellent self-sealing one-way function of the pouring nozzle can be developed.

On the other hand, the packed material can be poured again by tilting the package bag as described above, while the pouring can be stopped in the same manner as mentioned above. Even in this case, the pouring nozzle can develop the excellent one-way function against penetration of ambient air based on the automatic adhesion and sealing.

PATENT DOCUMENTS

Patent Document 1: JP-A-2005-15029
Patent Document 2: JP-A-2005-59958
Patent Document 3: WO2010/004853

SUMMARY OF THE INVENTION

Problems to be Solved by the Invention

The conventional filling and packing of the liquid material into the package bag described in Patent Documents 1 to 3 is mostly conducted by in-liquid packing with a large-size automatically packing machine or by other evacuation packing. Because, if ambient air exists in the package bag, there is a fear of causing oxidation, contamination or the like of the packed material during the storing, while the adhesion between the front and rear films can be inhibited and hence the one-way function cannot be developed in the above-mentioned pouring nozzles.

The present invention is made focusing on the evacuation packing of the liquid material into the package bag, and an object thereof is to provide a technique of filling and packing a liquid material to be packed into a package bag without intake of ambient air or the like by a simpler method as compared to the conventional in-liquid packing with an automatic machine such as automatic packing machine or the like. Also, it is to provide a package bag capable of surely preventing stay of ambient air or the like in the package bag and intake thereinto even in the filling by handwork or the like of an operator as well as a method for filing and packing the liquid material to be packed into the package bag.

Means for Solving Problems

The package bag of the present invention is characterized by comprising a bag main body made of thin laminate films for packing, a fusion part formed at a position spaced from a bottom portion of the bag main body not forming a nozzle through fusion by heat sealing, high frequency sealing, impulse sealing or the like and extending in a widthwise direction of the bag main body, an insert port for a pipe-like filling nozzle provided in a middle portion of the fusion part, for example, in a central portion thereof, a filling part of one-way function formed between the fusion part and an open end of the bag main body.

In the package bag, it is preferable that a flat film-like pouring nozzle made of thin laminate films with a self-sealing one-way function is disposed at a side of an upper end portion of the bag main body so as to protrude in a horizontal direction; that the insert port for the filling nozzle formed in the middle portion of the fusion part and made of a non-fusion part is a valley shape gradually denting toward a lower opening end of the bag main body; that the filling part of one-way function formed at the bottom of the bag main body is provided at its lower end portion with additional fusion parts extending in the widthwise direction of the bag main body and aligned straightforward in an oblique direction, a vertical direction or the like, while an insert port for the pipe-like filling nozzle is formed in a middle portion of the additional fusion parts in their extending direction; an insert port for the filling nozzle formed in a middle portion of the additional fusion part provided at the lower end portion of the filling part of one-way function and made of a non-fusion part is a mountain shape gradually protruding toward a filling space of the bag main body.

In these cases, it is preferable that the insert port for the filling nozzle is formed at a central portion in an extending direction of the one fusion part or the additional fusion part.

The method for filling and packing a liquid material to be packed into a package bag according to the present invention is a method for filling and packing a liquid material to be packed into any one of the above-mentioned package bags which comprises filling the liquid material into the package bag through a filling nozzle at a state of inserting the filling nozzle into the package bag through the insert port for the filling nozzle in the fusion part, automatically or manually pushing out the liquid packed material and a gas in the package bag after the removal of the filling nozzle to the filling part of one-way function through the insert port for the filling nozzle and overflowing them so that the filling part of one-way function is sufficiently adhered and sealed over the whole under the intervention of the liquid packed material through diffusion, for example, based on capillary action to render into a state of inhibiting penetration of ambient air into the package bag, and forming a fusion sealed part continuing over the full width of the package bag at a predetermined position of the package bag to seal the package bag.

In this method, it is preferable that a surplus portion of the package bag, namely the filling part of one-way function is cut off after the formation of the fusion sealed part continuing over the full width of the package bag.

Effect of the Invention

In the package bag of the present invention, the liquid material to be packed is filled into the filling space of the package bag for the liquid material from the insert port for the pipe-like filling nozzle formed in the fusion part extending in the widthwise direction of the bag main body, and thereafter the liquid packed material and a gas in the package bag are pushed out from the insert part for the filling nozzle to the filling part of one-way function, for example, by the handwork of the operator, and the fusion sealed part is formed over the full width of the package bag at a predetermined position of the package bag in this state by heat sealing, high frequency sealing or the like, whereby the gas existing in the package bag can be evacuated simply and surely, for example, by the handwork of the operator. In particular, according to the package bag of the present invention, the liquid packed material pushed out to the filling part of one-way function together with the gas is interposed between the fusion part and the open end of the bag main body to closely adhere the inner surfaces of the front side portion and the back side portion of the package bag to each other to thereby constitute a one-way function part inhibiting penetration of ambient air, which does not allow flowing back of the evacuated gas. Furthermore, penetration of ambient air into the package bag can be surely prevented when the fusion sealed part extending over the full width of the package bag is formed at a predetermined position by heat sealing, high frequency sealing or the like after the filling of the liquid material in the package bag, so that the risk of oxidation, degradation, contamination, corrosion or the like of the liquid material filled and packed in the package bag due to ambient air can be sufficiently removed.

Moreover, the above effect is developed more effectively in the case that the additional fusion part extending in the widthwise direction of the bag main body is formed in the lower end portion of the filling part of one-way function provided at the bottom portion of the bag main body, and the liquid material to be packed is filled into the filling space of the package bag for the liquid material through the pipe-like filling nozzle passing through both of the insert port for the filling nozzle formed in the middle portion in the extending direction of the additional fusion part and the insert port for the filling nozzle formed in the one fusion part at an upper end portion of the filling part of one-way function, and then all of the gas in the package bag is pushed together with the liquid packed material through each insert port for the filling nozzle into the filling part of one-way function and out of the package bag, for example, by the handwork of the operator, whereby the filling part of one-way function is acted as a one-way function part inhibiting penetration of ambient air when the inner surfaces of the front side and back side of the package bag are closely adhered to each other in the presence of the liquid packed material flowed therein.

Similarly, this can be performed when the liquid material to be packed is filled and packed in the package bag provided at the upper end portion of the bag main body with a flat-shaped pouring nozzle projecting to the horizontal direction and made of thin laminate films and having a self-sealing one-way function as described in Patent Documents 1 to 3. As a result, the one-way function of the pouring nozzle can be developed effectively, while the packed material in the bag can be protected from oxidation, deterioration or the like over a long period of time.

In such a package bag, when the insert port for the filling nozzle made of a non-fusion part and formed in the middle portion of the fusion part is a valley shape gradually denting toward the lower opening end at the bottom of the bag main body, there is an effect that the gas in the package bag can be always pushed surely and smoothly out of the package bag through the insert port for the filling nozzle provided in the fusion part, for example, by worker's fingers. Moreover, this is more effective when the insert port for the filling nozzle is formed in the central portion in the extending direction of the fusion part.

The fusion part is preferable to be extended so that each edge portion of the fusion part interposing the insert port of the filling nozzle is folded toward the open end of the bag main body. In this case, mutual adhesion force between the inner surfaces on the front side and the back side of the package bag is improved in the insert part for the filling nozzle to effectively develop the one-way function. Moreover, the corner of the end portion of the fusion part is preferable to be made to an arc (curved shape) by chamfering. This can expect an effect of easily inserting the filling nozzle into the insert port for the filling nozzle.

On the other hand, in case of providing additional fusion parts at the lower end of the filling part of one-way function, it is preferable that the insert port for the filling nozzle formed in the middle portion of the additional fusion part and made of a non-fusion part is a mountain shape gradually protruding toward the filling space of the bag main body. Thus, the filling nozzle for the liquid material to be packed can be inserted sufficiently smoothly into the insert port for the filling nozzle from the outside of the package bag. This is further effective when the insert port for the filling nozzle is provided in the central portion in the extending direction of the additional fusion part.

In the method for filling a liquid material to be packed according to the present invention, the filling nozzle is inserted preferably straightforward from the insert port for the filling nozzle formed in the fusion part into the package bag, and a predetermined amount of the liquid material to be packed is filled into the package bag through the filling nozzle at this state. After the filling nozzle is pulled out, all of the gas in the package bag is pushed and overflowed to the filling part of one-way function through the insert port for the filling nozzle together with a slight amount of the liquid packed material by pressing into the filling space of the bag main body, for example, with fingers of the operator. At this state, the fusion sealed part continuing over the full width of the package bag is formed in a predetermined position of the package bag. Thus, the inner surfaces of the front side and the back side of the package bag are adhered and closed to each other between the fusion sealed part and the open end of the bag main body in the presence of the thin film-like liquid packed material, whereby all of the gas existing in the package bag can be evacuated simply and surely, and also the backflow thereof can be prevented. Furthermore, when the fusion sealed part continuously extending over the full width of the package bag is formed at the predetermined position of the bag as mentioned above, the risk of penetrating ambient air into the package bag can be eliminated sufficiently to effectively prevent oxidation, degradation or the like of the packed material in the bag.

In this method, it is preferable to cut off the surplus portion of the package bag, namely the filling part of one-way function after the formation of the fusion sealed part continuously extending over the full width of the package bag. Thus, the package structure constituted by filling and packing the liquid material in the package bag can be easily and smoothly placed in a compact shape-keeping container or the like.

EMBODIMENTS FOR CARRYING OUT THE INVENTION

Figure 1:
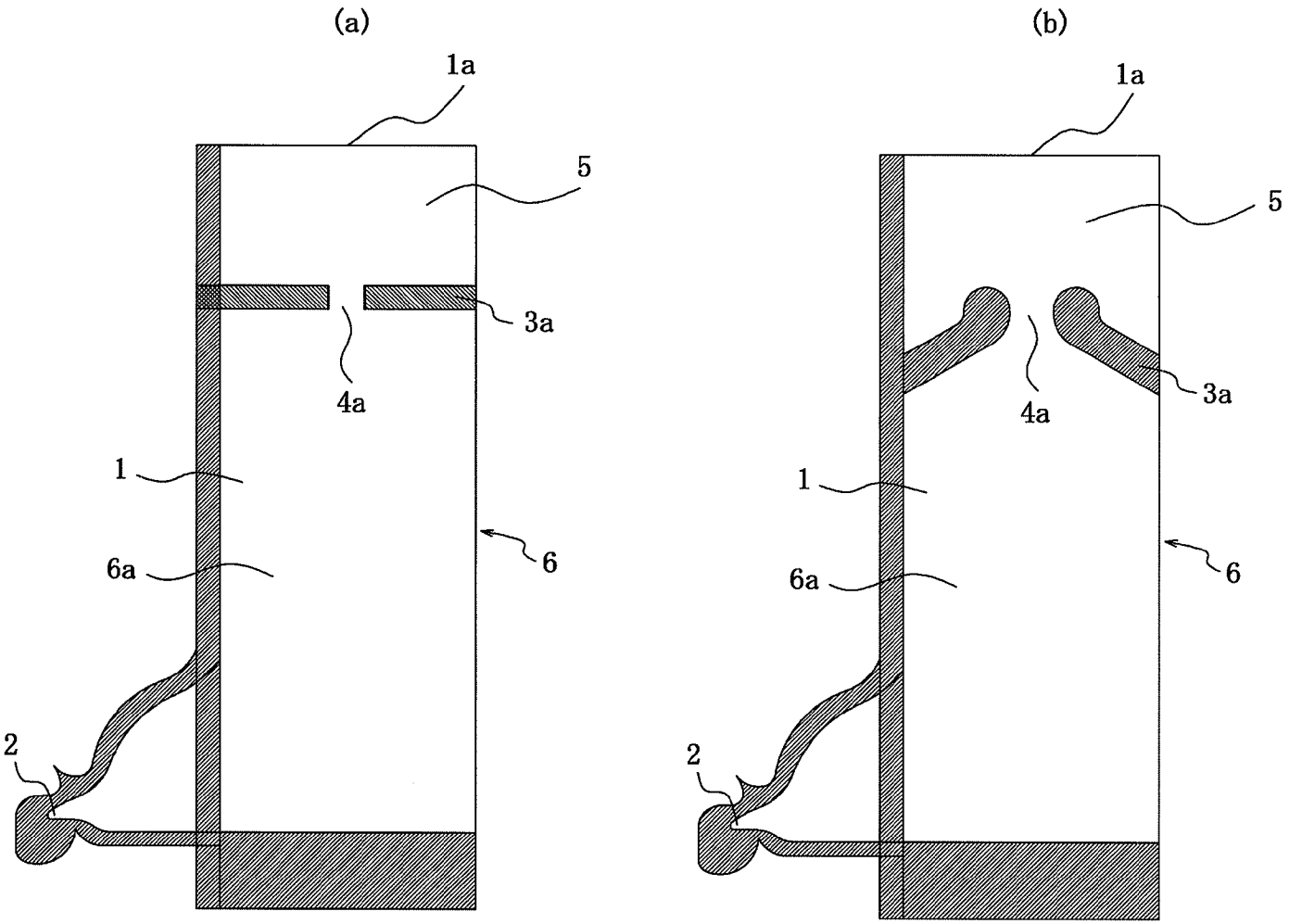
FIG. 1 is a plane view illustrating an embodiment of the package bag of the present invention at an up-and-down reversed posture.

In the embodiment of the package bag shown at an up-and-down reversed posture in FIG. 1, a fusion sealed part is formed in an upper end portion of a bag main body 1 made of thin plastic laminate films for packing as shown by hatched lines in the figure and a flat-shaped pouring nozzle 2 made of thin laminate films and having a self-sealing one-way function as described in Patent Documents 1 to 3 is integrally united into the bag main body 1 so as to horizontally protrude therefrom. Moreover, the package bag of the present invention is possible to omit the pouring nozzle 2.

In the package bag 6 as shown in FIG. 1 (*a*), sealant layers in the inner surfaces of the bag main body 1 are fused at one place in the opening portion of the bag main body 1 through, for example, heat sealing to form a fusion part 3*a* extending in the widthwise direction of the bag main body, while an insert port 4*a* for a filling nozzle made of a non-fusion part is formed in a middle portion in an extending direction of the fusion part, for example, in a central portion thereof, whereby a filling part of one-way function 5 inhibiting penetration of ambient air is defined between the insert port 4*a* for the filling nozzle and an opening end 1*a* at the bottom of the bag main body.

As shown in FIG. 1(*b*), the extending form of the fusion part 3*a* is a valley shape denting toward the open end 1*a* at the bottom of the bag main body, and the insert port 4*a* for the filling nozzle is provided at the valley-shaped central portion in the extending direction of the fusion part 3*a*, whereby the gas and the packed material can be smoothly pushed out to the filling part of one-way function 5 by pressing a filling space 6*a* with fingers or the like as mentioned later, and also backflow of them can be effectively prevented.

Also, each end portion of the fusion part 3*a* interposing the insert port 4*a* for the filling nozzle is preferable to be extended with bending towards the open end 1*a* of the bag main body 1 as shown in FIG. 1 (*b*). Thus, the mutual adhesion force between the laminate films of the front side and the back side for packing can be made strong at the insert port 4*a* for the filling nozzle to improve the one-way function. Furthermore, when the corners in the end portion of the fusion part 3*a* are chamfered into an arc shape (curved shape), the filling nozzle can be inserted simple into the insert port 4*a* for the filling nozzle without being obstructed with the end portion of the fusion part 3*a*.

Figure 2:
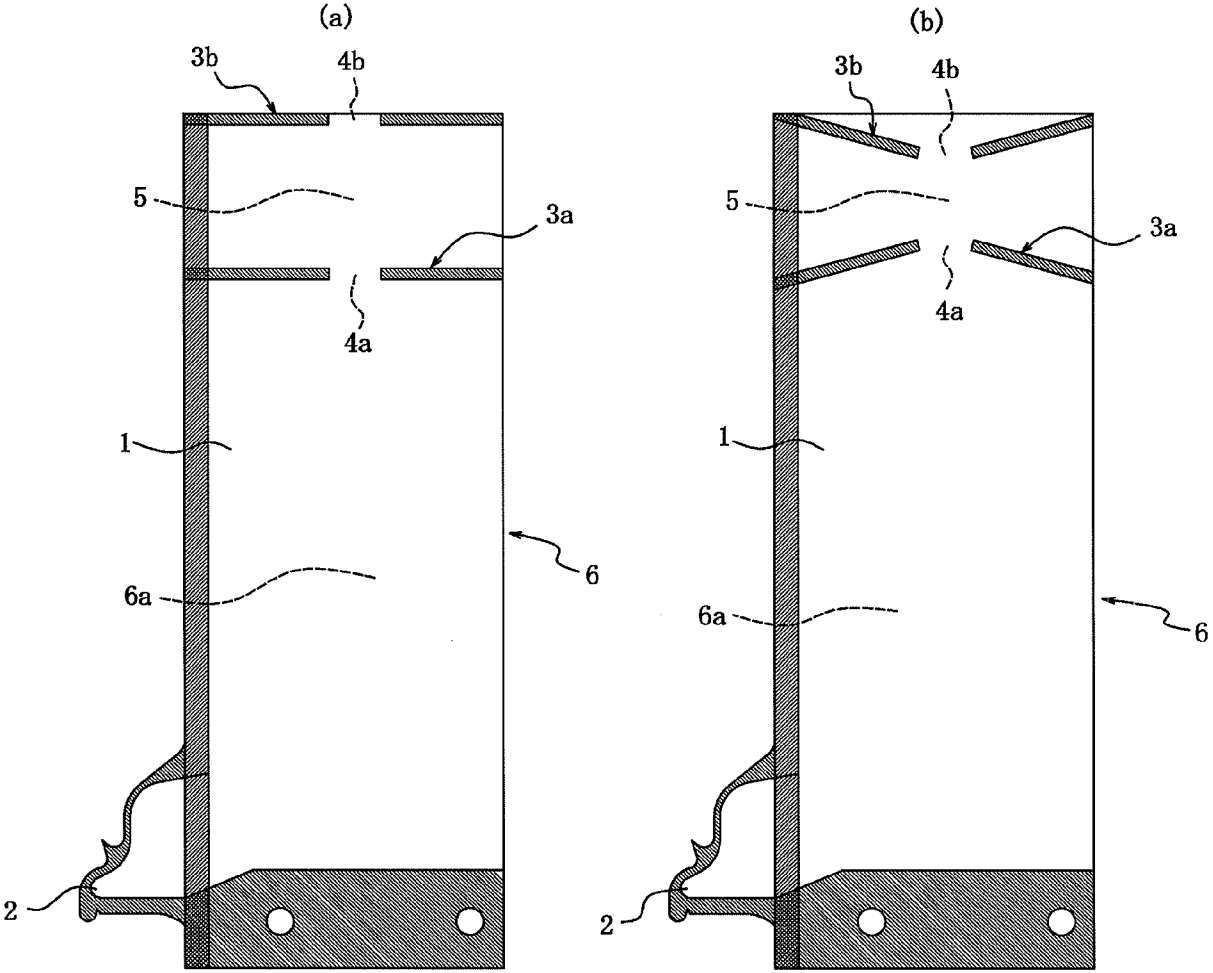
FIG. 2 is a plan view illustrating another embodiment of the package bag of the present invention at an up-and-down reversed posture.

On the other hand, the package bag of FIG. 2 shown at an up-and-down reversed posture is another embodiment of the package bag of the present invention, sealant layers in the inner surfaces of the bag main body are fused to each other at two places spaced in the vertical direction of the bag main body 1 in the opening portion at the bottom of the bag main body 1 through, for example, heat sealing to form fusion parts 3*a*, 3*b* extending in the widthwise direction of the bag main body (which is also referred to as "double fusion parts" hereinafter), while each of insert ports 4*a*, 4*b* for the insertion of the filling nozzle is formed at the middle portion, for example, the central portion in the extending direction of each of the double fusion parts, and aligned straightforward in the vertical direction in the figure, so that a portion between the double fusion parts 3*a*, 3*b* is defined as the filling part of one-way function 5 inhibiting penetration of ambient air to constitute the package bag 6.

Although the insert ports 4*a*, 4*b* for the filling nozzle are disposed to be aligned straightforward in the vertical direction of the bag main body 1 in FIG. 2, each of the insert ports 4*a* and 4*b* for the filling nozzle can also be aligned straightforward in a diagonal line upward to the right or the left at the illustrated posture, or they may be aligned depending on the way of bending in the case that the filling nozzle itself is bending.

The double fusion parts 3*a*, 3*b* shown in FIG. 2(*a*) are extended in parallel to each other in a direction perpendicular to the side edge of the bag main body 1. However, these fusion parts 3*a*, 3*b* may be extended so that one may incline to another.

Also, the fusion part 3*a* located close to the filling space 6*a* for the packed material in the double fusion parts 3*a* and 3*b* shown in FIG. 2(*b*) is provided so that the insert port 4*a* for the filling nozzle in the middle portion thereof is a valley shape gradually denting toward the opening end of the bag main body 1 or the other fusion part 3*b*, while the other fusion part 3*b* is provided so that the insert port 4*b* for the filling nozzle in the middle portion thereof is a mountain shape gradually projecting toward the filling space 6*a*. Moreover, one or both of these fusion parts 3*a*, 3*b* may be extended straightforward as shown in FIG. 2(*a*).

Here, the top portion or the bottom portion of the double fusion parts 3*a*, 3*b* can also be located so as to be offset in the widthwise direction of the bag main body 1. Also, the inclination of each of the fusion part 3*a* (valley shape) and the fusion part 3*b* (mountain shape) can be properly chosen, if necessary.

Even in this case, the insert ports 4*a*, 4*b* for the filling nozzle aligned straightforward in the vertical direction of the bag main body 1 can be ones aligned straightforward in a diagonal direction or the like.

Although it is not illustrated, at least one of the extending shapes of the double fusion parts 3*a*, 3*b* formed at the bottom of the bag main body 1 can be a curved shape, a sinusoidal shape, or the like.

Moreover, although it is not illustrated, it is preferable that each end portion of the fusion parts 3*a*, 3*b* sandwiching the insert ports 4*a*, 4*b* for the filling nozzle as shown in FIG. 1(*b*) is preferable to be extended in a folding shape toward the one of the fusion parts 3*a*, 3*b* and made to an arc (curved shape). In that case, the insertion of the filling nozzle into the insert ports 4*a*, 4*b* for the filling nozzle becomes easy, while the one-way function can be improved by mutual adhesion of the front and back laminate films at the insert ports 4*a* and 4*b* for the filling nozzle to effectively prevent the backflow of the gas and the liquid packed material discharged from the filling space 6*a*.

Moreover, the opening width of the insert ports 4*a*, 4*b* for the filling nozzle is preferable to be 5 mm to 30 mm in the package bag with a volume of about 100 ml to about 750 ml. In this range, the one-way function at the filling part of one-way function 5 can be effectively developed.

Figure 3:
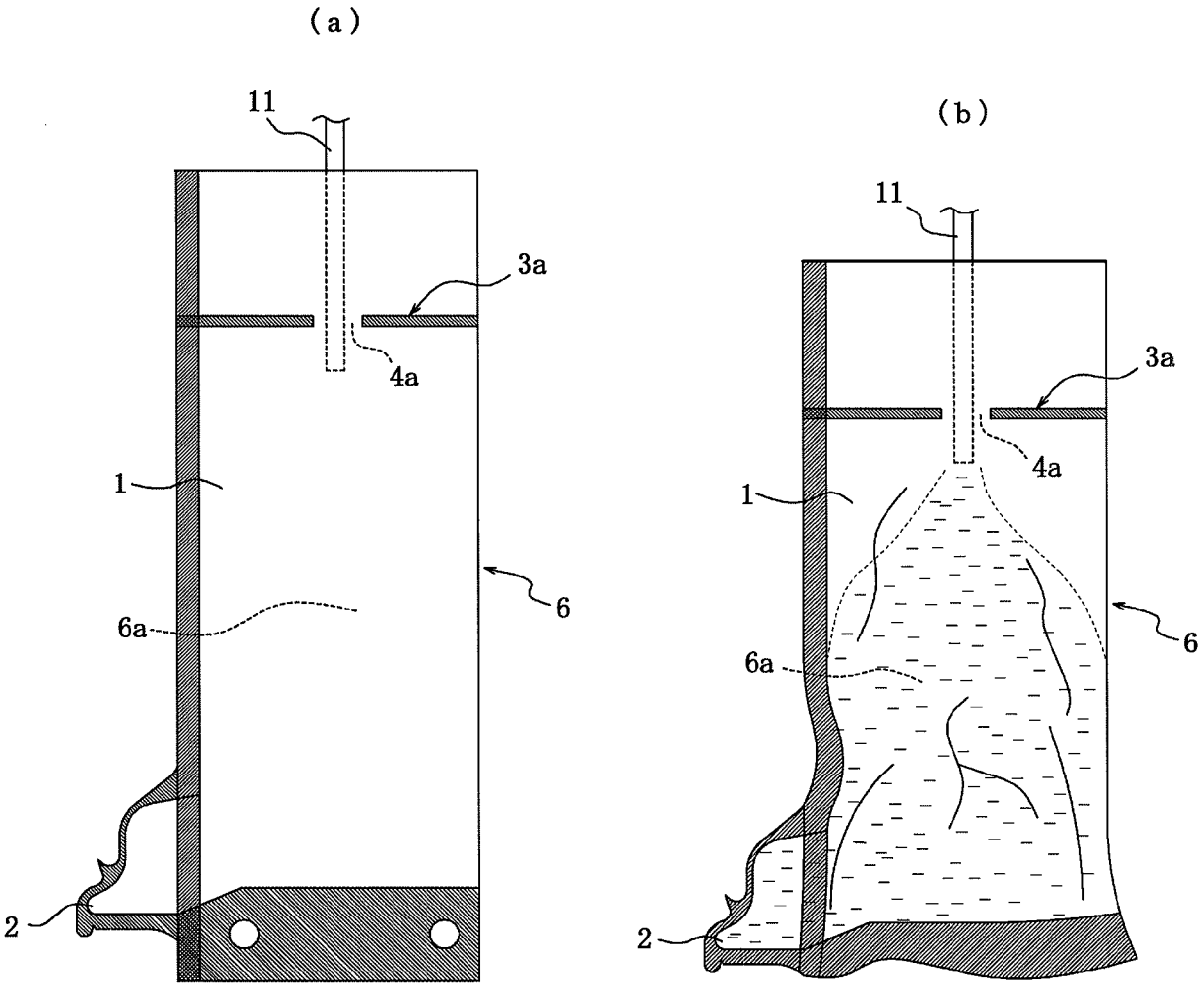
FIG. 3 is a front view illustrating a step of filling a liquid material to be packed into a package bag.

When the predetermined liquid material to be packed is filled and packed into the package bag 6 having the above construction, as illustrated using the package bag of FIG. 3(*a*), firstly the predetermined amount of the liquid material to be packed is filled into the package bag 6 through a filling nozzle 11 as shown in FIG. 3(*b*) at a state of inserting the filling nozzle 11 extending, for example, straightforward into the package bag 6 from the insert port 4*a* for the filling nozzle made of a non-fusion part.

Figure 4:
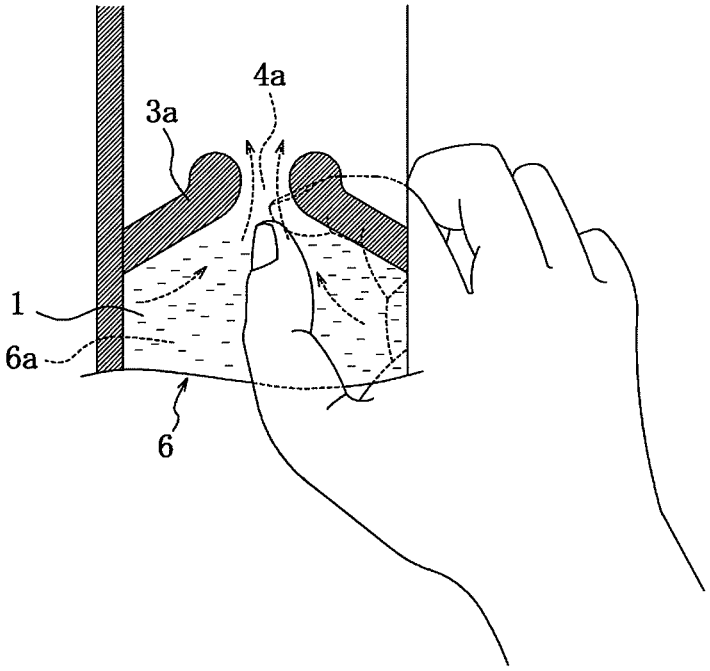
FIG. 4 is a front view illustrating a step of pushing out a gas in a package bag.
Figure 5:
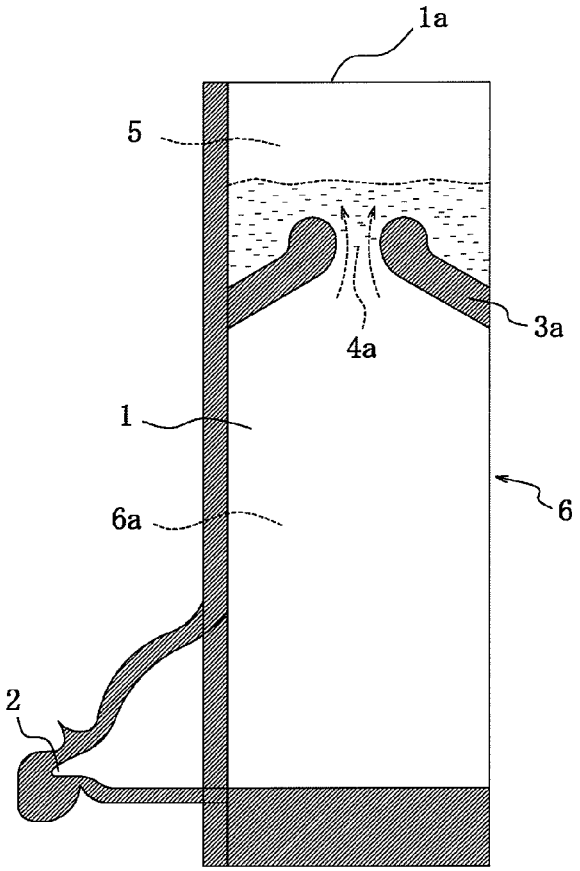
FIG. 5 is a front view illustrating a step of pushing out a gas in a package bag and flowing a liquid packed material into a filling part of one-way function.

After the filling of the predetermined amount of the liquid material, the filling nozzle 11 is taken out from the insert port 4*a* for the filling nozzle, and then the liquid material to be packed is pushed from the outside of the package bag 6, for example, with worker's fingers or under the use of a suitable tool and as shown in FIG. 4, all of the gas in the package bag 6 is pushed out from the insert port 4*a* for the filling nozzle and flown into the filling part of one-way function 5 together with a small amount of the packed material. Thus, a portion between the fusion part 3*a* and the opening end 1*a* acts as a filling portion of one-way function 5 in the presence of a thin film of the liquid packed material flown therein based on capillary action or the like, whereby the inner surfaces of the front side and back side portion of the package bag 6 are closely adhered to each other and sealed as shown by an enlarged view in FIG. 5.

Figure 6:
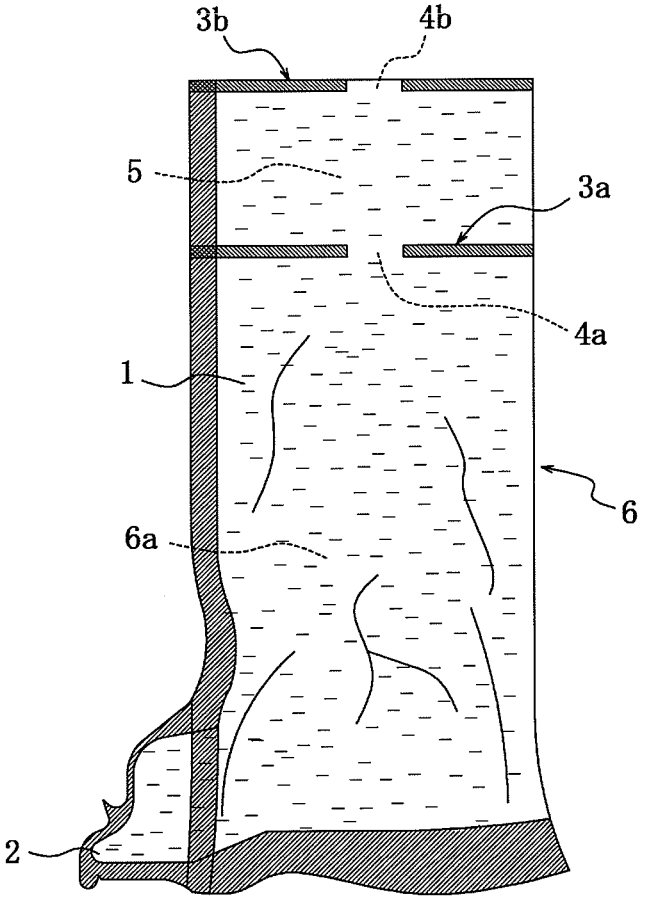
FIG. 6 is a front view showing an action state of a filling part of one-way function between double fusion parts.

In such a closely sealed state, the gas discharged from the package bag does not cause backflow, and the penetration of ambient air into the package bag 6 can be surely inhibited in the subsequent handling of the package bag 6 as shown in FIG. 6 illustrated using the package bag with the double fusion parts 3*a*, 3*b*.

Figure 7:
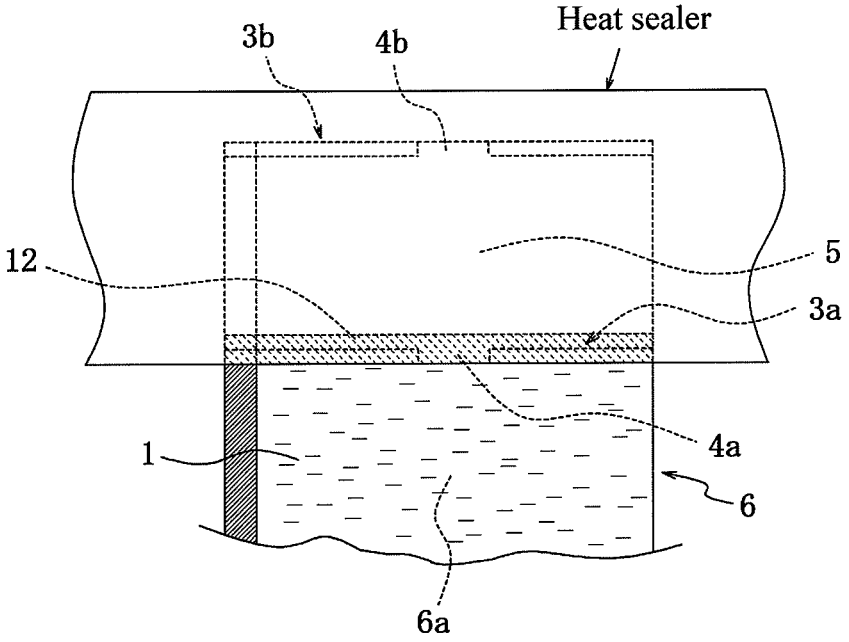
FIG. 7 is a front view illustrating a step of forming a fusion sealed part continuing over a full width of a package bag.

Thereafter, a fusion sealed part 12 continuously extending over the full width of the package bag 6 is formed at a predetermined position in the bottom opening portion of the package bag 6, for example, through heat sealing as shown in FIG. 7 to seal the package bag 6, whereby the seal-filling and packing of the liquid material to be packed is completed.

The package bag 6 is comprised of laminate films having two- or three-layer structure, which is constituted by an uniaxially or biaxially oriented base film layer of a polyethylene terephthalate film layer (PET layer), a nylon resin film layer (NY layer), an ethylene vinyl alcohol (EVOH) or the like with a thickness of 8 to 30 μm and a sealant layer of a non-oriented PE layer, PP layer, EVA layer, ionomer layer, EVOH layer or the like with a thickness of 10 to 60 μm, and it is preferable to select ones containing no additive such as surfactant depending on a kind of the liquid material to be filled.

As the base film layer, the above-mentioned PET layer and NY layer are preferable in view that the excellent steam impermeability and high gas barrier property are developed. As the sealant layer, the PE layer and PP layer are excellent in the heat-sealing property at a relatively low temperature, and are preferable in view of improving the sealing strength. When the thickness of the base film layer in the package bag 6 is less than 8 μm, the steam impermeability, gas barrier property and the like may be feared lacking, while when it exceeds 30 μm, the bending strength of the laminate film becomes too large and there is a fear of damaging the adhesion property between the inner surfaces of the package bag 6 in the one-way function part 5. Also, when the thickness of the sealant layer is less than 10 μm, there is a fear of not ensuring the sufficient sealing strength, while when it exceeds 60 μm, the bending strength of the laminate film may be too large. The sealant layer can be made of two or more film layers as long as the total thickness of the layers can be in the above-mentioned range.

Figure 8:
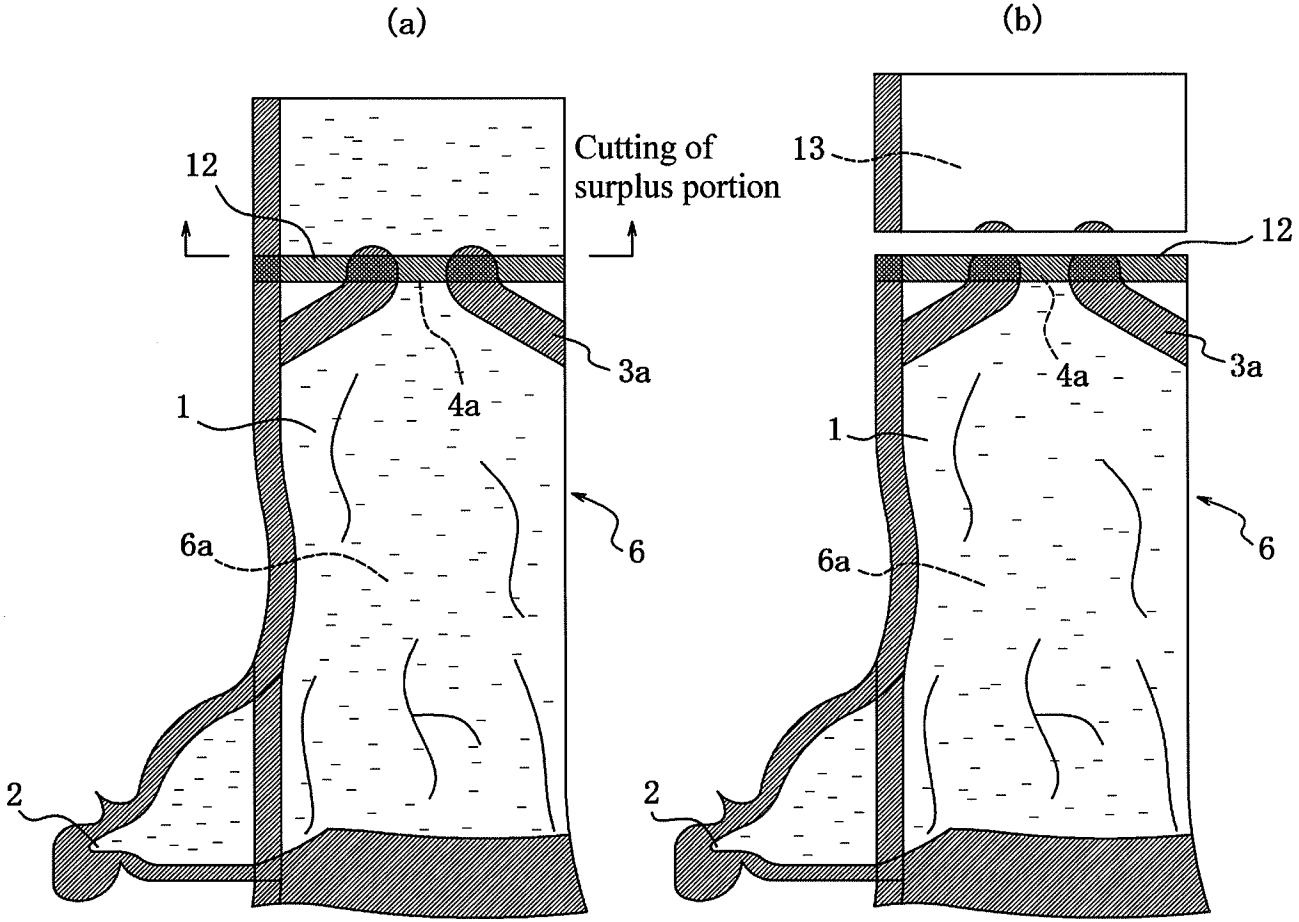
FIG. 8 is a front view (a) showing a state of filling and sealing a liquid packed material and a front view (b) illustrating a step of cutting off a filling part of one-way function in a package bag structure.
Figure 9:
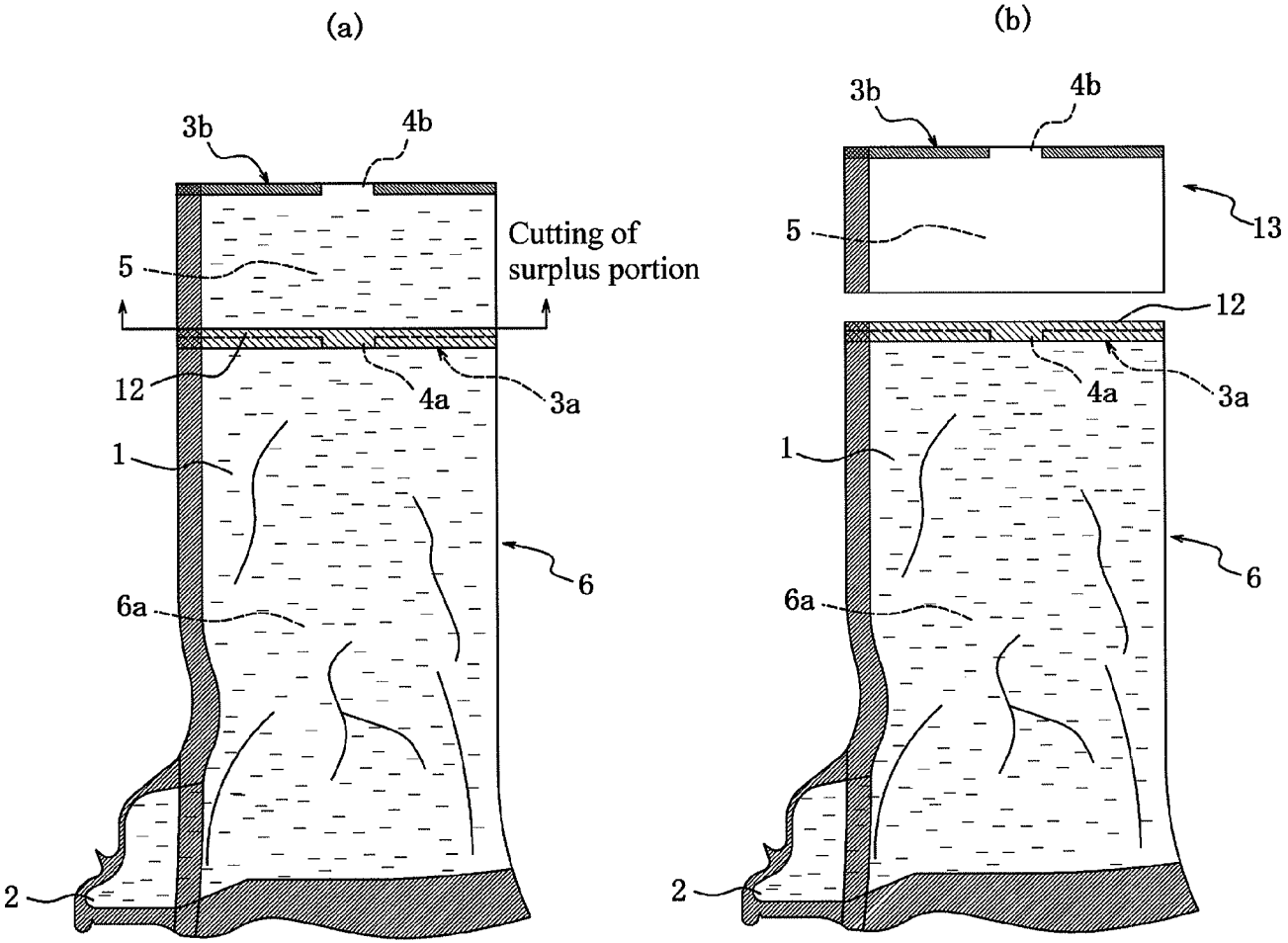
FIG. 9 is a front view (a) showing a state of filling and sealing a liquid packed material and a front view (b) illustrating a step of cutting off a filling part of one-way function in a package bag structure.

According to the present invention, as shown in FIGS. 8 and 9, a surplus portion 13 of the package bag 6, namely filling part of one-way function 5 after the filling and packing of the liquid material is cut out so as to leave the fusion sealed portion 12 with a shear means or the like such as scissors or the like to make easy and smooth the arrangement of the package structure filled and packed with the liquid material into a compact shape-keeping container or the like.

In this case, if the area of the surplus portion 13 is made to minimal level by selecting the forming position of the fusion part 3*a* (FIG. 8) or the interval between the fusion parts 3*a* and 3*b* (FIG. 9) in the formation of the double fusion parts 3*a*, 3*b*, the yield of the material can be improved advantageously.

Although the embodiment of the present invention is described with reference to the drawings, the present invention can be applied to the package bag having no one-way function pouring nozzle 2 as previously mentioned. Also, the extending shape of the fusion parts 3*a*, 3*b* can be properly varied, if necessary.

DESCRIPTION OF REFERENCE SYMBOLS

1 bag main body
1*a* opening end
2 pouring nozzle
3*a*, 3*b* fusion part
4*a*, 4*b* insert port for filling nozzle
5 filling part of one-way function
6 package bag
6*a* filling space
11 filling nozzle
12 fusion sealed portion
13 surplus portion

The invention claimed is:

1. A package bag comprising a bag main body made of thin laminate films for packing, having a fusion part formed at a position spaced from a bottom portion of the bag main body and extending in a widthwise direction of the bag main body, an insert port for a pipe-like filling nozzle provided in a middle portion of the fusion part, a filling space provided between an upper end portion of the bag main body and the fusion part, and a filling part of one-way function due to mutual adhesion between inner surfaces of the thin laminate films under the interposition of the liquid packed material pushed out from the filling space formed between the fusion part and an unsealed opening end at the bottom of the bag main body, the fusion part having a valley shape indented toward the unsealed opening end at the bottom of the bag main body and the insert port for the filling nozzle made of a non-fusion part provided at the valley portion of the fusion part.

2. A package bag according to claim 1, wherein a flat film-like pouring nozzle made of thin laminate films with a self-sealing one-way function due to mutual adhesion between inner surfaces of the thin laminate films wetted with packed material is disposed at a side of an upper end portion of the bag main body so as to protrude in a horizontal direction.

3. A package bag according to claim 1, wherein the filling part of one-way function formed at the bottom of the bag main body is provided at its lower end portion with additional fusion parts extending in the widthwise direction of the bag main body, while an insert port for the pipe-like filling nozzle is formed in a middle portion of the additional fusion parts in their extending direction.

4. A package bag according to claim 3, wherein the additional fusion part has a mountain shape gradually protruding toward a filling space of the package main body.

5. A package bag according to claim 1, wherein each end portion of the fusion part forming the insert port for the filling nozzle has a bent portion extending toward the opening end at the bottom of the bag main body.

6. A method for filling and packing a liquid material to be packed into a package bag as claimed in claim 1, which comprises filling the liquid material into the package bag through a filling nozzle at a state of inserting the filling nozzle into the package bag through the insert port for the filling nozzle in the fusion part, pushing out the liquid packed material and a gas in the package bag after the removal of the filling nozzle to the filling part of one-way function through the insert port for the filling nozzle and overflowing them so that the filling part of one-way function is sufficiently adhered and sealed over the whole under the intervention of the liquid packed material to render into a state of inhibiting penetration of ambient air into the package bag, and forming a fusion sealed part continuing over the full width of the package bag at a predetermined position of the package bag to seal the package bag.

7. The method for filling and packing a liquid material to be packed according to claim 6, wherein the filling part of one-way function is cut off after the formation of the fusion sealed part continuing over the full width of the package bag.

* * * * *